US007235140B1

(12) United States Patent
Hayes et al.

(10) Patent No.: US 7,235,140 B1
(45) Date of Patent: Jun. 26, 2007

(54) METHOD FOR CLEANING TISSUE PROCESSING MOLDS

(76) Inventors: Steve Hayes, 13109 Dawson Ct., Oklahoma City, OK (US) 73142; Doug Low, 800 N. Peniel, Oklahoma City, OK (US) 73127

( * ) Notice: Subject to any disclaimer, the term of this patent is extended or adjusted under 35 U.S.C. 154(b) by 265 days.

(21) Appl. No.: 10/649,239

(22) Filed: Aug. 27, 2003

(51) Int. Cl.
*B08B 7/04* (2006.01)

(52) U.S. Cl. ..... 134/5; 435/40.5; 422/1; 422/28; 422/292; 422/302; 210/273; 134/26; 134/34; 134/35; 134/40; 134/42

(58) Field of Classification Search ..... 435/40.5; 422/1, 28, 292, 302; 210/773; 134/5, 26, 134/34, 35, 40, 42
See application file for complete search history.

(56) References Cited

U.S. PATENT DOCUMENTS

| | | | | |
|---|---|---|---|---|
| 2,681,298 | A * | 6/1954 | Ferrari | 435/40.52 |
| 3,674,396 | A | 7/1972 | McCormick | |
| 3,689,319 | A * | 9/1972 | Sample et al. | 134/40 |
| 4,220,252 | A | 9/1980 | Beall et al. | |
| 4,405,854 | A * | 9/1983 | Lapointe | 219/421 |
| 4,421,246 | A * | 12/1983 | Schultz et al. | 422/102 |
| 5,250,117 | A * | 10/1993 | Hirano et al. | 134/1 |
| 5,427,742 | A | 6/1995 | Holland | |
| 5,672,696 | A * | 9/1997 | Wang et al. | 536/25.42 |
| 5,843,700 | A * | 12/1998 | Kerrod et al. | 435/40.5 |
| 5,882,597 | A | 3/1999 | Astle | |
| 6,303,076 | B1 * | 10/2001 | Yamamoto et al. | 419/14 |
| 6,432,215 | B1 * | 8/2002 | Gamache et al. | 134/10 |
| 6,632,598 | B1 * | 10/2003 | Zhang et al. | 435/4 |
| 2004/0002163 | A1 * | 1/2004 | Reinhardt et al. | 436/174 |
| 2004/0021239 | A1 * | 2/2004 | Mazzanti | 264/39 |

FOREIGN PATENT DOCUMENTS

| | | | |
|---|---|---|---|
| EP | 1295690 | A1 * | 3/2003 |

* cited by examiner

*Primary Examiner*—Sharidan Carrillo
(74) *Attorney, Agent, or Firm*—Dunlap Codding & Rogers

(57) ABSTRACT

The present invention is directed to a cleaning system and methods for cleaning tissue embedding molds. The cleaning system includes a cleaning vessel that holds a cleaning solution. The tissue processing molds are supported by a basket receptacle which is placed inside the cleaning vessel. Cleaning solution is supplied to the cleaning vessel through a supply line. Additional fluids are stored in a reservoir and may be mixed with the cleaning solution in the supply line. Cleaning solution drains from the cleaning vessel through a drain line. A controller controls the opening and closing of valves and the activation or deactivation of a heat source to operate a wash cycle, a rinse cycle, and a dry cycle.

13 Claims, 6 Drawing Sheets

METHOD FOR CLEANING TISSUE PROCESSING MOLDS

CROSS REFERENCE TO RELATED APPLICATIONS

Not Applicable.

BACKGROUND OF THE INVENTION

To facilitate microscopic examination of pathology tissue specimens, tissue specimens are typically treated with processing fluids, encased in a block of paraffin, and then sliced into thin sections. This process is carried out by placing each tissue specimen in a tissue processing cassette. Such cassettes used for pathology tissue specimens for microscopic examination are well known. While tissue processing cassettes vary in design, tissue processing cassettes generally include an open-topped base having a perforated bottom wall and a removable perforated cover. The cassettes are generally fabricated of a moldable plastic that resists damage or reaction from processing solvents or the tissue specimen itself.

To process a tissue specimen for examination, the tissue specimen is placed into the base of the cassette and the cover is secured to the base. The cassette and the tissue specimen are then placed in a tissue cassette processing container where various processing fluids are passed into the cassette for the purpose of dehydrating the specimen, clearing the specimen, and infiltrating the specimen with molten paraffin. After this process is completed, the cover is removed from the base and the specimen is taken from the base and placed in a tissue embedding mold.

The tissue embedding mold is typically constructed of stainless steel and configured to support the specimen in a lower portion thereof and to support the base of the cassette in an upper portion thereof. With the specimen and the base positioned in the mold, the mold is filled via the perforations of the base of the cassette with liquid paraffin or some other suitable encasing material. Upon the paraffin solidifying, the specimen becomes encased within a block of paraffin which extends from the base of the cassette. The base and the block of paraffin can then be mounted in a microtome where a section of the tissue specimen can be sliced for microscopic examination.

After a paraffin-encased tissue specimen is removed from the mold, the mold needs to be cleaned thoroughly before the mold can be used again. In the past, workers have cleaned molds by placing them in a bath of heated xylene. Unfortunately, xylene is highly flammable and thus presents an obvious fire and explosive danger.

Thus, there is a need for a method by which the tissue processing molds can be cleaned without creating a fire or explosive danger. It is to such a method that the present invention is directed.

DETAILED DESCRIPTION OF THE INVENTION

Figure 1:
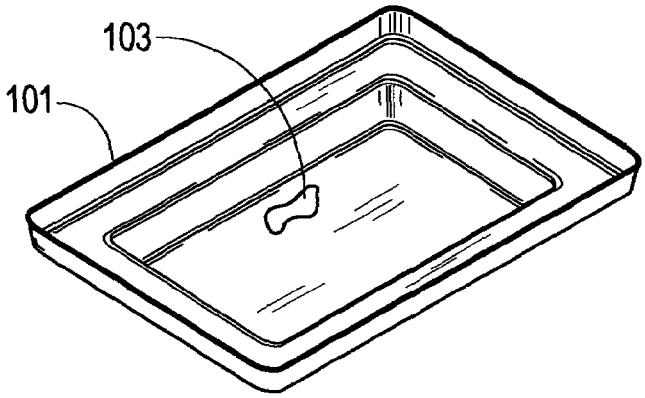
Fig. 1 (Prior Art)
FIG. 1 is a perspective view of a prior art tissue embedding mold.

Referring now to the drawings and more particularly to FIG. 1, a tissue embedding mold 101 is shown to have a generally rectangular structure. In ordinary use, as noted above, the tissue embedding mold 101 is filled with paraffin to encase a specimen located in the tissue embedding mold 101. After being used, the tissue embedding mold 101 usually contains some paraffin residue 103 at a bottom or along sidewalls of the tissue embedding mold 101.

Figure 2:
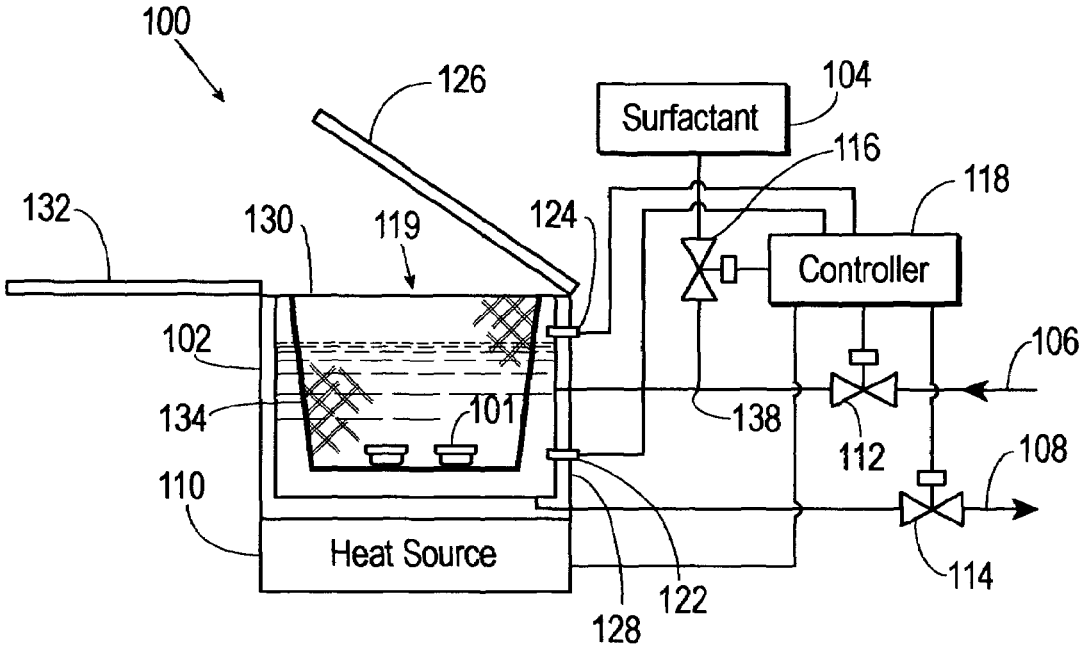
FIG. 2 is a schematic view of a system for cleaning tissue embedding molds in accordance with the present invention.

FIG. 2 shows a schematic view of a cleaning system 100 for removing paraffin from a tissue embedding mold 101. As shown in FIG. 2, the cleaning system 100 includes a cleaning vessel 102, a surfactant reservoir 104, a solution supply line 106, a drain line 108, a heat source 110, a supply valve 112, a drain valve 114, a surfactant supply valve 116, and a controller 118. One or more molds 101 are placed in a mold receiving chamber 119 of the cleaning vessel 102 and covered with a cleaning solution. The cleaning solution may be water or a mixture of water and a surfactant or a paraffin dissolving solvent. The cleaning vessel 102 has a low-level sensor 122 and a high-level sensor 124 that indicate whether the cleaning solution is in contact with the low-level sensor 122 or the high-level sensor 124. The low-level sensor 122 and the high-level sensor 124 are connected by wiring to the controller 118. The lid 126 is pivotally attached to a cleaning vessel base 128.

The molds 101 may be supported in the cleaning vessel by a basket 130 having a handle 132. The handle 132 is used by a worker to manually support the basket 130 during removal or insertion of the basket 134 into the cleaning vessel 102. An outside surface of the handle 132 is preferably made of a rubber or other tactile material to facilitate manipulation of the basket 130. The tactile material of the handle 132 is preferably wrapped around a thermally insulating material, such as ceramic, to retard heat conduction through the handle 132 and thereby prevent the worker from being burned.

In operation, the cleaning system 100 is automatically controlled by the controller 118. The controller 118 includes a temperature setting device, a wash cycle timer set, a rinse cycle timer, and a dry cycle timer set, which will be discussed below in reference to FIG. 5. After an operator loads the molds 101 into the basket receptacle 134, closes the lid 126 and places inside the cleaning vessel 102, the operator sets the temperature setting device to a design temperature, selects a wash cycle timer setting, a rinse cycle timer setting, a dry cycle timer setting, and then turns on a switch to activate the controller 118. Alternatively, the controller 118 can be configured to begin operation upon closing of the lid 126.

For the first time operation of the cleaning system 100, the cleaning vessel 102 initially contains no cleaning solution. When the controller 118 is activated, the cleaning solution supply valve 112 opens to allow cleaning solution, or other solvent, to flow into the cleaning vessel 102. The surfactant supply valve 116 also opens to mix a controlled amount of surfactant with the water at a T-connection 138. The cleaning solution then fills the cleaning vessel 102 until the high-level sensor 124 senses the presence of liquid, at which time the controller 118 closes the cleaning solution supply valve 112 and the surfactant supply valve 116.

When the cleaning vessel 102 is filled with the cleaning solution, the heat source 110 activates to begin heating the solution in the cleaning vessel 102. It is generally contemplated that the heating solution supplied to the cleaning vessel 102 is ordinary hot water supplied by a commercial hot water heater in a building. However, the water may also be cold water or a paraffin solvent in which case the heat source 110 must supply heat to achieve a specified design temperature. The water may also need to be chemically treated with softeners to extend the life of the components of the cleaning system 100.

The amount of surfactant in the aqueous solution is preferably in a range from about 1:5 to about 1:500. One suitable concentration of the aqueous solution is 1 part surfactant to 20 parts water. Suitable chemicals for the surfactant include alkalines.

It is generally contemplated that the heat source 110 has one or more electrical heating elements that fit beneath the cleaning vessel 102. However, the heat source 110 may also be natural gas or may be one or more electrical heating elements located inside the cleaning vessel 102.

The heat source 110 is designed to heat the cleaning solution to a design temperature that is at least equal to the melting temperature of the paraffins used for the tissue processing molds 101. This design temperature is typically at least 60 degrees centigrade (140 degrees Fahrenheit). In one preferred embodiment, the design temperature is at least 100 degrees centigrade (212 degrees Fahrenheit) so that the aqueous cleaning solution will boil and sufficiently agitate the cleaning solution in the cleaning vessel 102 to facilitate removal of the paraffin from the molds 101.

After a wash cycle time which begins when the heat source 110 is activated, the heat source 110 deactivates, the water drain valve 114 opens and the cleaning solution drains from the cleaning vessel 102 through the water drain line 108. When a level of the cleaning solution in the cleaning vessel drops below the level of the low-level sensor 122, the water drain valve 114 closes.

A wash cycle is defined to include all of the operations that occur from the opening of the cleaning solution supply valve 112 through the closing of the cleaning solution drain valve 114. A rinse cycle performs the same operations as a wash cycle except that the surfactant supply valve 116 never opens to mix the surfactant with the water and, as a result, also does not subsequently close when the high-level sensor 124 detects the presence of cleaning solution. Thus, the rinse cycle operates with rinse solution being the only liquid inside the cleaning vessel 102.

Using a design temperature of 60° C. and wash cycle times and rinse cycle times of three minutes, tests with typical paraffins have shown that programming the controller to operate three wash cycles followed by two rinse cycles performs a thorough cleaning of the tissue embedding molds 101.

When the heater source 100 is heated to produce design temperatures of at least 100° C. for aqueous cleaning solutions, the cleaning system 100 must also include provisions for venting steam away from any personnel near the cleaning vessel 102. It is generally contemplated that the amount of paraffin used with the processing molds will not cause problems with the sewer system of the building where the tissue processing molds 101 are cleaned. However, if there is a problem, the drain line 108 may be connected to a system to remove or recover paraffin from the waste water, which is discussed in relation to FIG. 3.

Figure 3:
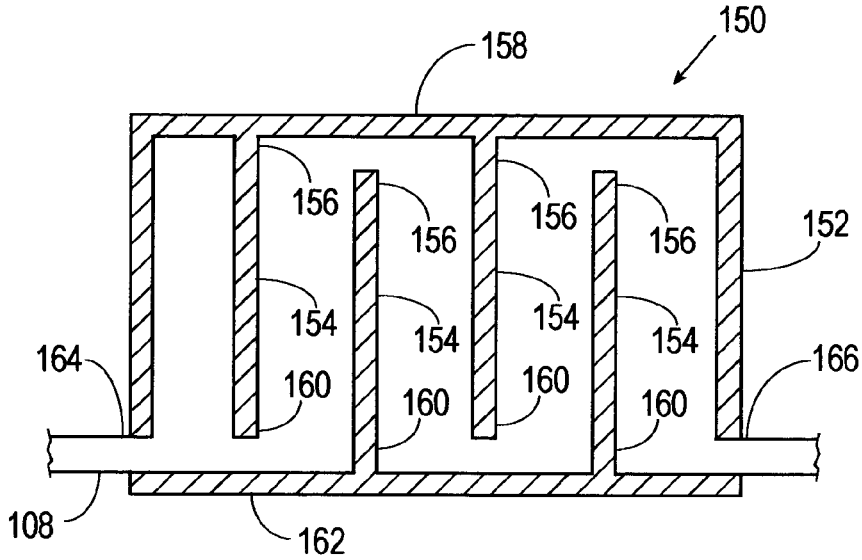
FIG. 3 is a section view of a paraffin recovery system in accordance with the present invention.

FIG. 3 shows a paraffin recovery system 150. The paraffin recovery system 150 includes a tank 152 that receives waste cleaning solution through the drain line 108 shown in FIG. 2. The paraffin recovery system 150 also includes several thermoelectric baffles 154 positioned inside the tank 132. Each baffle 154 includes a cold end 156 located near a top 158 of the tank and a hot end 160 located near a bottom 162 of the tank 152. The cold end 156 is maintained at a temperature below the melting point of the paraffin and the hot end 160 is heated to a temperature of at least the melting point of the paraffin.

The thermoelectric baffles 154 are solid-state electrically-driven heat exchangers that can pump heat in a certain direction depending on a polarity of an applied voltage. The baffles operate by the Peltier Effect, by which a temperature gradient can be induced when an electrical current flows through a junction of dissimilar metals. A typical thermoelectric cooler consists of alternating blocks of N-type and P-type bismuth telluride semiconductors sandwiched between, and soldered to, two opposing thin ceramic plates.

The waste solution, which generally comprises cleaning solution and paraffin, enters the tank 152 at an inlet 164 and exits the tank 152 through an outlet 166. When the waste water travels over the baffle cold ends 156, the paraffin cools sufficiently to congeal and separate from the waste aqueous solution. The congealed paraffin collects on top cold ends 156 of the baffles 154. After several uses of the cleaning system 100 and the paraffin recovery system 150, a worker must scrape the paraffin from the baffles 154. Liquid that travels through the paraffin recovery system 150 exits the outlet 166 as a treated aqueous solution. The treated cleaning solution may then be passed to the sewer line of a building or maybe passed into the mold receiving chamber 119 of the cleaning vessel 102 for reuse.

Figure 4:
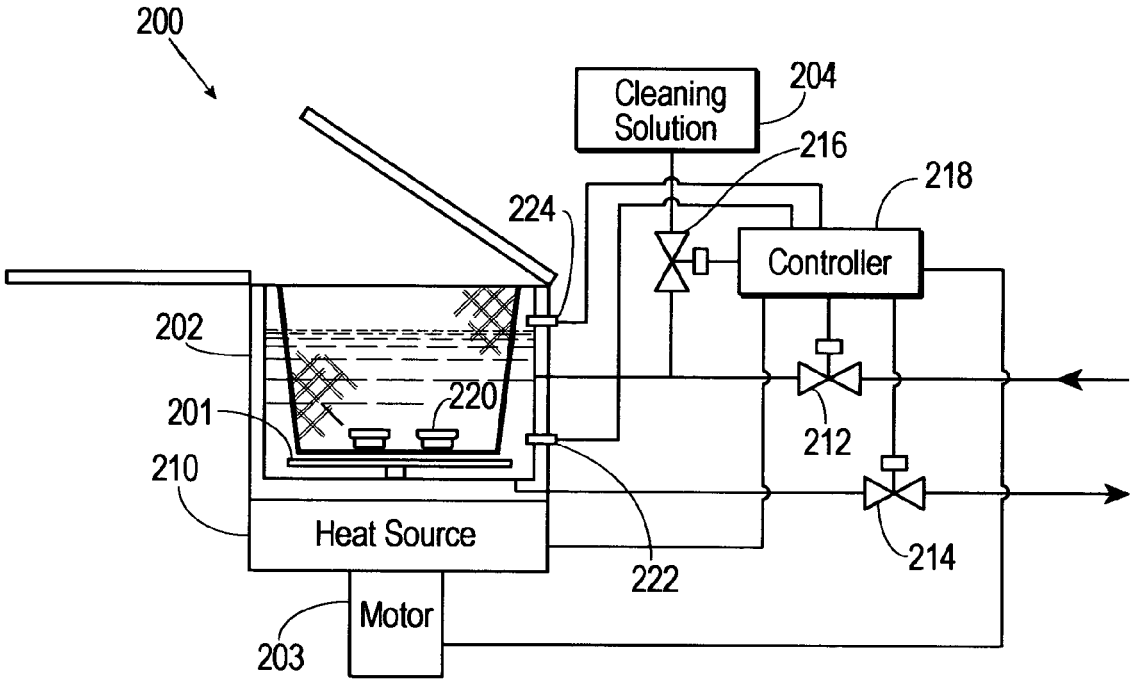
FIG. 4 is a schematic view of another embodiment of a system for cleaning tissue embedding molds in accordance with the present invention.

FIG. 4 shows an alternate embodiment of a cleaning system 200 for cleaning tissue processing molds 220 that is identical to the cleaning system 100, except that a mechanical agitator 201 is positioned in a bottom of a cleaning vessel 202. The cleaning system 200 also includes similar components to the cleaning system 100, including a surfactant reservoir 204, a heat source 210, a cleaning solution supply valve 212, a drain valve 214, a surfactant supply valve 216, a controller 218, a low-level sensor 222, and a high-level sensor 224.

The mechanical agitator 201 agitates fluid inside the cleaning vessel 202 to assist in removing paraffin from the tissue processing molds 220. The mechanical agitator 201 is coupled to an electric motor 203 that fits beneath the cleaning vessel 202 and is operably connected to a controller 218 that activates and deactivates the electric motor 203. In one preferred embodiment, the electric motor 203 rapidly alternates rotation directions between a clockwise and a counterclockwise direction.

Figure 5:
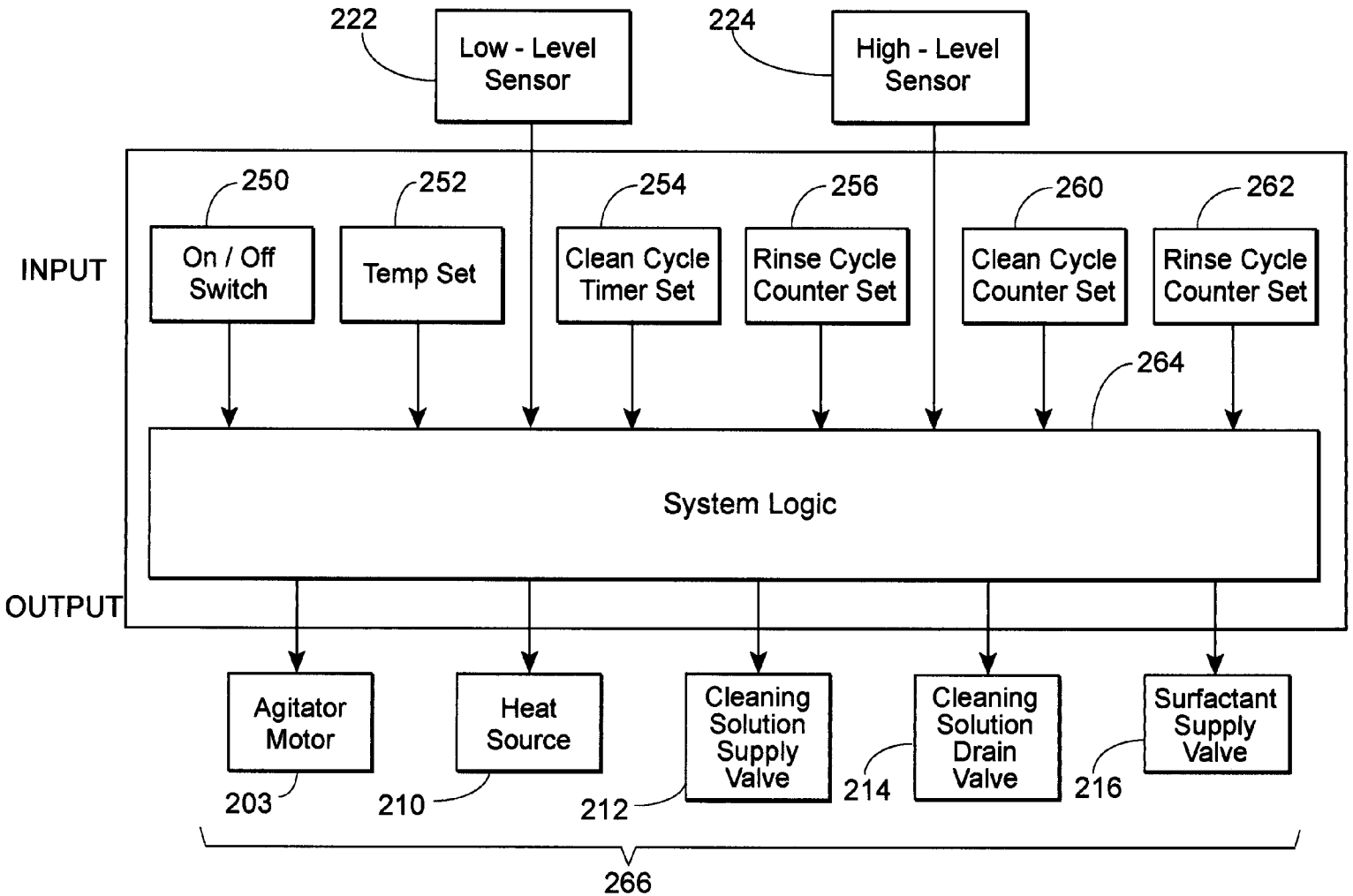
FIG. 5 is a schematic view of a controller for a cleaning system illustrating the functions of the controller.

FIG. 5 shows a schematic diagram that illustrates the operation of the controller 218 shown in FIG. 4. The controller 218 has an on/off switch 250 that activates operation of the cleaning system 200. The controller 218 has a temperature setting device 252 to manually set the operating design temperature of the heat source 210.

The controller 218 also includes a wash cycle timer set 254 and a rinse cycle timer set 256. Each of the wash cycle timer set 254 and the rinse cycle timer set 256 are devices for which a cycle time of each can be specified by an operator. The controller 218 also includes a wash cycle counter set 260 and a rinse cycle counter set 262 to set the number of wash cycles and the number of rinse cycles that the cleaning system 200 will perform.

The low-level sensor 222 and the high-level sensor 224 sense the presence or absence of aqueous solution as described above for the cleaning system 200. The controller 218 also includes a system logic device 264 that outputs signals based on input signals received from the low-level sensor 222, the high-level sensor 224, the on/off switch 250, the temperature setting device 252, the wash cycle timer set 254, the rinse cycle timer set 256, the dry cycle timer set 258, the wash cycle counter set 260, and the rinse cycle counter set 262. Based on the input signals received, the system logic 264 outputs signals to controlled components 266 of the cleaning system 200. The controlled components are the agitator motor 203, the heat source 210, the cleaning solution supply valve 212, the drain valve 214, and the solution supply valve 216.

The system logic 264 may include analog electrical devices such as resistors, capacitors, inductors, switches, time-delay relays and other control relays. The system logic 264 may also be a microprocessor which must first convert the electrical input signals to digital data signals with a analog-to-digital converter. After the system logic 264 of the microprocessor processes the digital data signals, a digital-to-analog converter must be used to generate electrical signals for operating the controlled components 266. The system logic 264 may also be a combination of analog and digital components.

Although the controller 218 has been shown as having operator-controlled variables, such as wash cycle time settings, rinse cycle time settings, dry cycle time settings, numbers of wash cycles, and numbers of rinse cycles, these operator-controlled variables may be set to fixed values after further use and experimentation determines that fixing these operator-controlled variables is appropriate. For example, it may later be determined that a time of four minutes is an appropriate time for both the wash cycle time setting and the rinse cycle time setting. Then, these variables can be fixed in the system logic 264 so that the operator has few decisions to make to operate the cleaning system 200. This in turn would allow the cleaning system 200 to be operated by inexperienced or less experienced operators.

Figure 6:
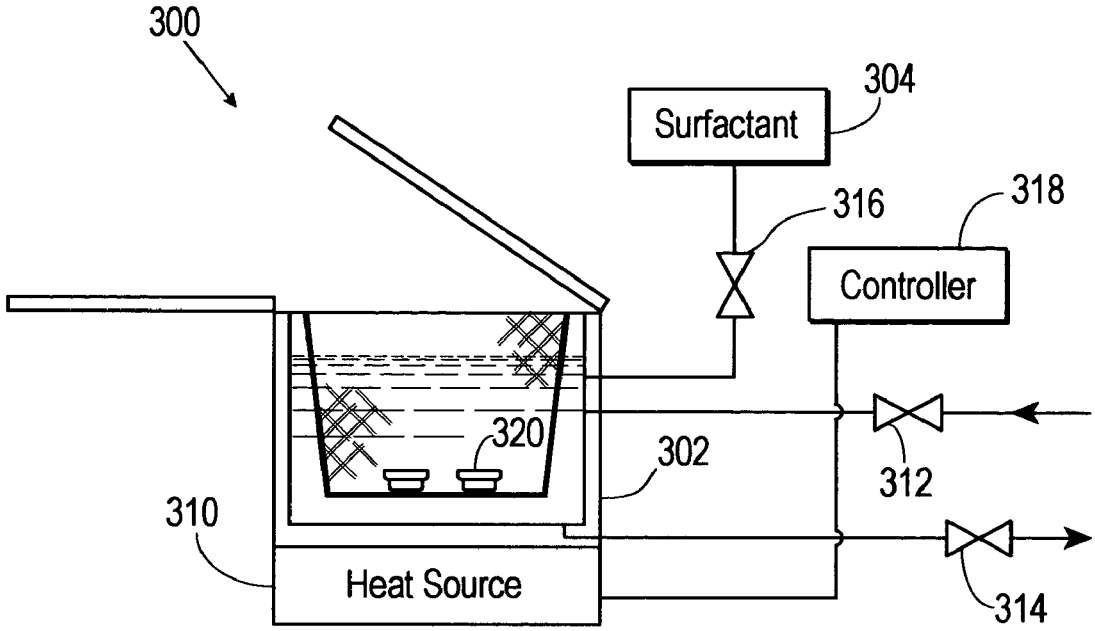
FIG. 6 is a schematic view of another embodiment of a system for cleaning tissue embedding molds in accordance with the present invention.

FIG. 6 shows an alternate embodiment of a manually controlled cleaning system 300. The cleaning system 300 operates similarly to the cleaning system 100, except that most of the various components of the cleaning system 300 are manually controlled by an operator. Surfactant is stored in a surfactant reservoir 304. For the cleaning system 300, the operator manually operates a cleaning solution supply valve 312, a cleaning solution drain valve 314, and a surfactant supply valve 316.

After selecting and setting a design temperature, the operator opens the cleaning solution supply valve 312 to let water or other solvent into a cleaning vessel 302 until the cleaning vessel 302 is sufficiently filled with cleaning solution. Next, if water is used as the solvent, the operator opens the solution supply valve 316 to let surfactant flow into the cleaning vessel 302. Alternatively, the cleaning system 300 may be configured without a surfactant supply valve 316, in which case the cleaning solution is poured into the cleaning solution from a container holding the cleaning solution.

Next, the operator adjusts a temperature control knob on controller 318 and turns on a heat source 310 by turning on a switch on the controller 318. When the heat source 310 has operated for a certain wash cycle time interval, the operator can then drain the cleaning vessel 302 by opening water drain valve 314. The wash cycle and the rinse cycle are timed by the operator using an ordinary watch or clock.

For this manual operation, the operator may visually inspect tissue processing molds 320 after each wash cycle to ensure that all paraffin has been removed. If there is still paraffin on the molds 320, the operator can operate another wash cycle using a different wash cycle time. On a second or subsequent wash cycle, the heat source temperature may be adjusted to a higher level. When enough wash cycles have been operated to completely remove the paraffin, at least one rinse cycle should be operated with rinse solution and no cleaning solution to remove surfactant from the molds 320.

The manual cleaning system 300 can have advantages in that the manual cleaning system 300 may use less energy, may require less time and may be more efficient. The automatic cleaning systems 100 and 200 have advantages in that the automatic cleaning systems 100 and 200 may remove dirt, bacteria and tissue fragments not visible to the naked eye, does not require monitoring by the operator, and may be less expensive to operate when the cost of human monitoring are taken into account.

Figure 7:
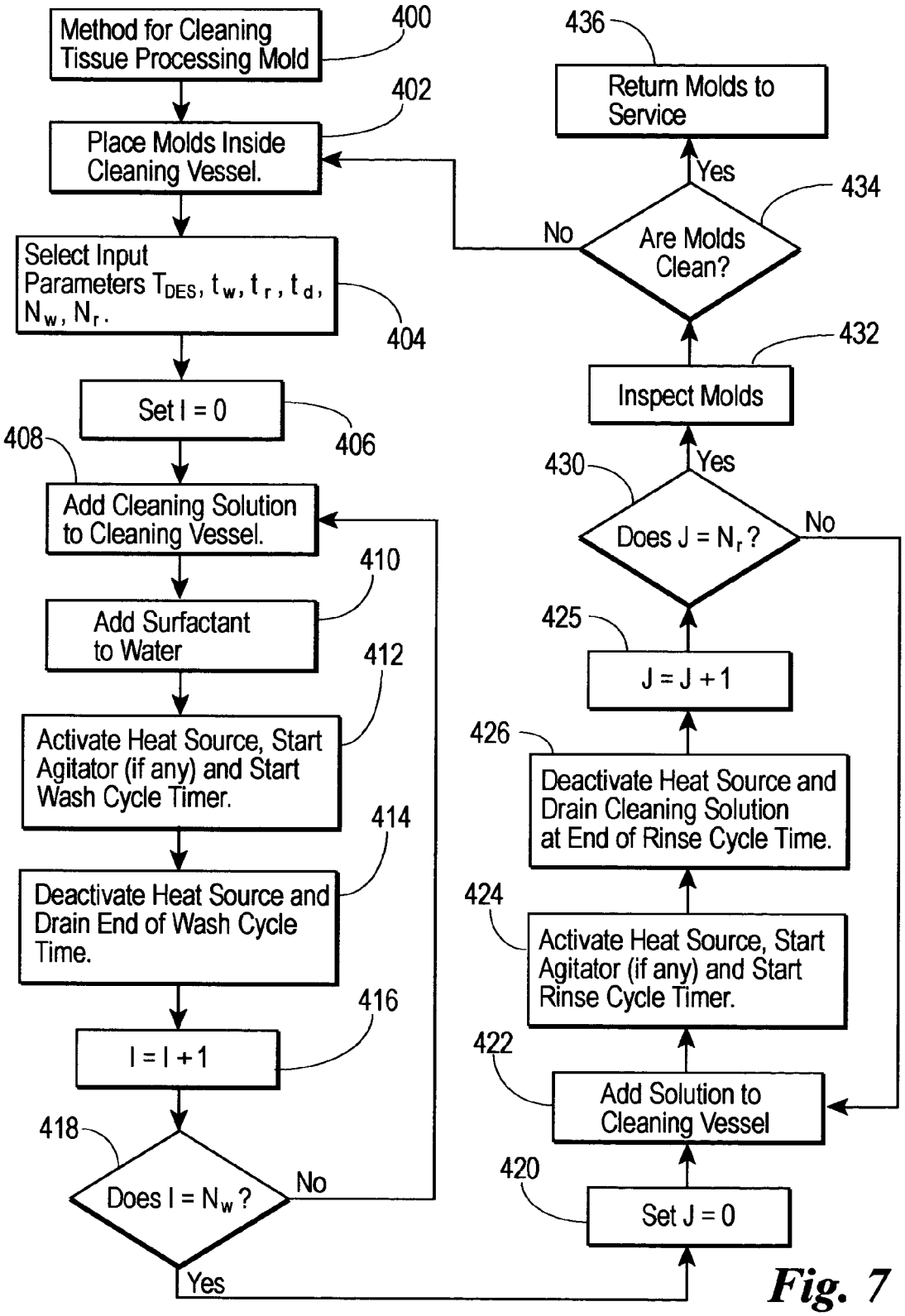
FIG. 7 is a flow chart for a method for cleaning the tissue embedding molds in accordance with the present invention.

FIG. 7 is a flow chart for a method 400 for cleaning the tissue processing molds. At step 402, the molds are placed inside the cleaning vessel. At step 404, the input parameters are selected. The input parameters include the design temperature, the wash cycle time $t_w$, the rinse cycle time $t_r$, the dry cycle time $t_d$, the number of wash cycles $N_w$, and the number of rinse cycles $N_r$. At step 406, a wash cycle counter I is set to zero. At step 408, water is added to the cleaning vessel.

At step 410, surfactant is added to the aqueous or non aqueous solution. At step 412, the heat source is activated at the selected design temperature setting. For cleaning systems having an agitator, the agitator motor is also activated at step 412 to agitate the cleaning solution. The wash cycle timer also begins operating when the heat source is activated at step 412.

At the end of the selected wash cycle time $t_w$, at step 414, the heat source is deactivated and the cleaning solution is drained from the cleaning vessel. In one preferred embodiment, the wash cycle time is about five minutes. At step 416, the wash cycle counter is updated from I to I+1. At step 418, the wash cycle counter I is compared to the selected value of the numbers of wash cycles $N_w$ to be performed. If I is less than $N_w$, then the wash cycle is repeated. If I is equal to $N_w$, then the wash cycle is ended.

The rinse cycle begins at step 420 by setting rinse cycle counter J to zero. At step 422, rinse solution is added to the cleaning vessel. At step 424, the heat source is activated and, if the cleaning system has an agitator, the agitator is activated. A rinse cycle timer is also started at step 424. At step 426, after a selected rinse cycle time $t_r$, the agitator is deactivated (if applicable) and the cleaning solution is drained from the cleaning vessel. At step 428, the value of the counter J is updated to have the value of J+1. At step 430, the value of J is compared to the value of $N_r$. If the value of J is less than $N_r$, then the rinse cycle is repeated. If the value of J equals $N_r$, then the rinse cycle is ended.

At step 432, the cleaned and dried molds are inspected. At step 434, an operator inspects the molds to determine whether the molds are clean. If the molds are clean, the molds are returned to service at step 436. If the molds are not sufficiently clean, the molds are returned to the cleaning system at step 402 to be cleaned again.

Figure 8:
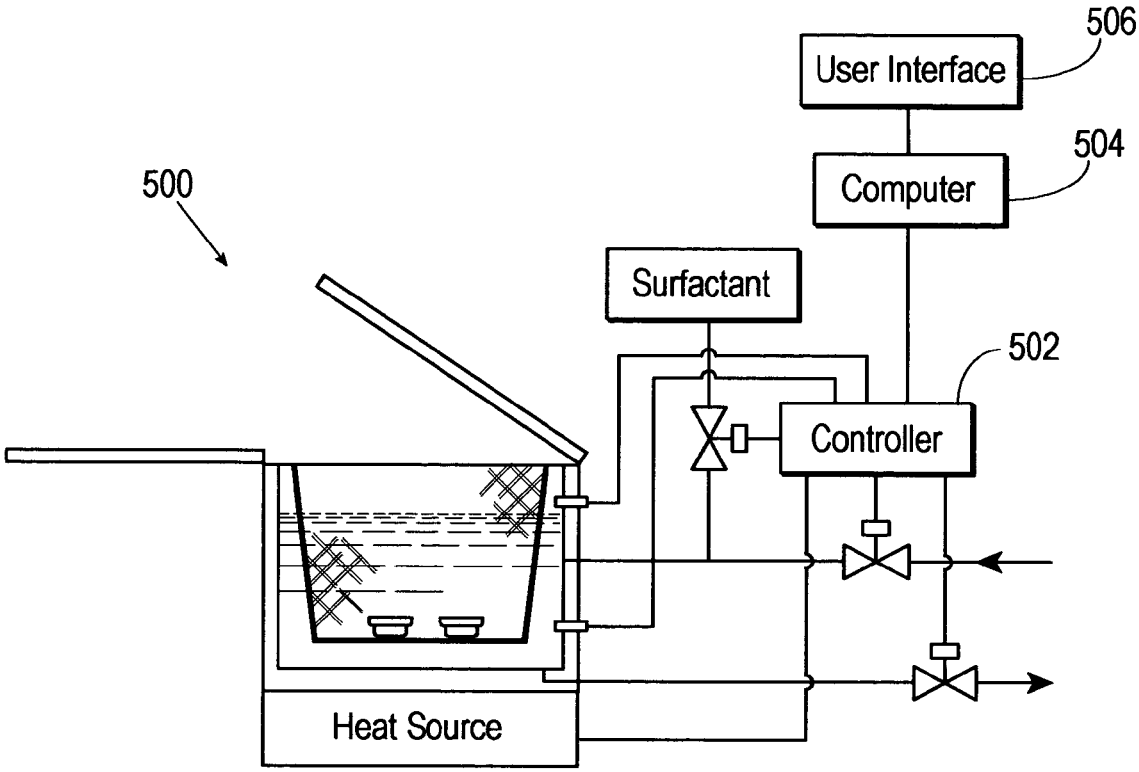
FIG. 8 is a schematic view of another embodiment of a system for cleaning tissue embedding molds connected to a computer, in accordance with the present invention.

FIG. 8 shows a cleaning system 500 having a controller 502 connected to a computer 504 with a monitor or other user interface 506. The computer 504 has programming to prompt an operator to enter input parameters such as a wash cycle timer setting, a rinse cycle timer setting, a dry cycle timer setting, a design temperature, a number of wash cycles to be operated and a number of rinse cycles to be operated. The programming may also have a default setting for the input parameters so that the operator may simply select the "default settings" option to operate the system.

From the above description, it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed as defined in the appended claims.

What is claimed is:

1. A method for removing paraffin from a tissue embedding mold, comprising the steps of:

(a) placing a tissue embedding mold containing paraffin in a mold receiving chamber of a cleaning vessel;

(b) introducing an aqueous cleaning solution into the mold receiving chamber of the cleaning vessel in an amount to cover the tissue embedding mold;

(c) heating the aqueous cleaning solution to at least the melting point of the paraffin contained on the tissue embedding mold;

(d) maintaining the tissue embedding mold in the heated aqueous cleaning solution for a selected period of time wherein at least a portion of the paraffin on the tissue embedding mold melts from the tissue embedding mold to produce a paraffin containing aqueous cleaning solution;

(e) removing the paraffin containing aqueous cleaning solution from the mold receiving chamber of the cleaning vessel;

(f) repeating steps (b)–(e) until the tissue embedding mold is substantially free of paraffin;

(g) introducing the paraffin containing aqueous cleaning solution removed from the mold receiving chamber of the cleaning vessel into a tank provided with a plurality of baffles;

(h) heating a lower end of the baffles to a temperature at least the melting point of the paraffin;

(i) maintaining an upper end of the baffles at a temperature below the melting point of the paraffin;

(j) passing the paraffin containing aqueous cleaning solution over the upper end of the baffles where the paraffin in the paraffin containing aqueous cleaning solution solidifies on the upper end of the baffles thereby separating the paraffin from the paraffin containing aqueous cleaning solution to produce a treated aqueous cleaning solution; and (k) removing the treated aqueous cleaning solution from the tank.

2. The method of claim 1 further comprising the step of: agitating the aqueous cleaning solution to facilitate removal of paraffin from the tissue embedding mold.

3. The method of claim 1 further comprising the step of: introducing a surfactant to the aqueous cleaning solution prior to introducing the aqueous cleaning solution into the mold receiving chamber of the cleaning vessel.

4. The method of claim 1 further comprising the step of: removing the treated aqueous cleaning solution from the tank into the mold receiving chamber of the cleaning vessel for reuse.

5. The method of claim 1 further comprising the step of removing the paraffin from the upper end of the baffles.

6. The method of claim 2 wherein the aqueous cleaning solution is agitated by heating the aqueous cleaning solution to at least the boiling point of the aqueous cleaning solution.

7. A method for removing paraffin from a tissue embedding mold, comprising the steps of:

(a) placing a tissue embedding mold containing paraffin in a mold receiving chamber of a cleaning vessel;

(b) introducing a paraffin dissolving solvent into the mold receiving chamber of the cleaning vessel in an amount to cover the tissue embedding mold;

(c) maintaining the tissue embedding mold in the paraffin dissolving solvent for a selected period of time wherein at least a portion of the paraffin on the tissue embedding mold dissolves from the tissue embedding mold to produce a paraffin containing paraffin dissolving solvent;

(d) removing the paraffin containing paraffin dissolving solvent from the mold receiving chamber of the cleaning vessel;

(e) repeating steps (b)–(d) until the tissue embedding mold is substantially free of paraffin;

(f) introducing the paraffin containing paraffin dissolving solvent removed from the mold receiving chamber of the cleaning vessel into a tank provided with a plurality of baffles;

(g) heating a lower end of the baffles to a temperature at least the melting point of the paraffin;

(h) maintaining an upper end of the baffles at a temperature below the melting point of the paraffin;

(i) passing the paraffin containing paraffin dissolving solvent over the upper end of the baffles where the paraffin in the paraffin containing paraffin dissolving solvent solidifies on the upper end of the baffles thereby separating the paraffin from the paraffin containing paraffin dissolving solvent to produce a treated paraffin dissolving solvent solution; and (j) removing the treated paraffin dissolving solvent solution from the tank.

8. The method of claim 7 further comprising:

heating the paraffin dissolving solvent to at least the melting point of the paraffin contained on the tissue embedding mold.

9. The method of claim 7 further comprising the step of: introducing a surfactant to the paraffin dissolving solvent prior to introducing the paraffin dissolving solvent into the mold receiving chamber of the cleaning vessel.

10. The method of claim 7 further comprising the step of: removing the treated paraffin dissolving solvent solution from the tank into the mold receiving chamber of the cleaning vessel for reuse.

11. The method of claim 7 further comprising the step of removing the paraffin from the upper end of the baffles.

12. The method of claim 8 further comprising the step of: agitating the paraffin dissolving solvent to facilitate removal of paraffin from the tissue embedding mold.

13. The method of claim 12 wherein the paraffin dissolving solvent is agitated by heating the paraffin dissolving solvent to at least the boiling point of the paraffin dissolving solvent.

* * * * *